US010468828B2

(12) United States Patent
Yeh

(10) Patent No.: US 10,468,828 B2
(45) Date of Patent: Nov. 5, 2019

(54) ELECTRIC CONNECTOR

(71) Applicant: V-GENERAL TECHNOLOGY CO., LTD., New Taipei (TW)

(72) Inventor: Po-Wen Yeh, New Taipei (TW)

(73) Assignee: V-GENERAL TECHNOLOGY CO., LTD., New Taipei (TW)

( * ) Notice: Subject to any disclaimer, the term of this patent is extended or adjusted under 35 U.S.C. 154(b) by 0 days.

(21) Appl. No.: 16/169,989

(22) Filed: Oct. 24, 2018

(65) Prior Publication Data

US 2019/0165519 A1 May 30, 2019

(30) Foreign Application Priority Data

Nov. 24, 2017 (TW) ..... 106140959 A

(51) Int. Cl.
*H01R 24/62* (2011.01)
*H01R 13/6585* (2011.01)

(52) U.S. Cl.
CPC ..... *H01R 13/6585* (2013.01); *H01R 24/62* (2013.01)

(58) Field of Classification Search
CPC ..... H01R 23/688; H01R 23/6873; H01R 23/7073; H01R 23/02; H01R 13/648; H01R 13/652; H01R 13/6585; H01R 24/62
USPC ..... 439/660, 108
See application file for complete search history.

(56) References Cited

U.S. PATENT DOCUMENTS 6,280,209 B1 * 8/2001 Bassler ..... H01R 12/724 439/101
6,312,269 B1 * 11/2001 Obata ..... H05K 1/141 174/261
6,537,086 B1 * 3/2003 MacMullin ..... H01R 23/688 439/79
6,648,657 B1 * 11/2003 Korsunsky ..... H01R 13/6594 439/108
7,708,569 B2 * 5/2010 Sercu ..... H01R 12/724 439/108
8,827,750 B2 * 9/2014 Chung ..... H01R 13/6461 439/660
8,894,451 B2 * 11/2014 Shiratori ..... H01R 13/6471 439/660
2003/0180011 A1 * 9/2003 Aronson ..... H01R 23/688 385/92
2004/0018759 A1 * 1/2004 Wu ..... H01R 13/6471 439/108

(Continued)

*Primary Examiner* — Gary F Paumen
(74) *Attorney, Agent, or Firm* — Leong C. Lei

(57) ABSTRACT

The electric connector conforms to the HDMI and DP specifications and includes at least an insulating member, a first conductor set, and a second conductor set. Each conductor includes a contact terminal, an intermediate conductor, and a welding terminal. A first grounding conductor in the second conductor set has forked intermediate conductors and welding terminals disposed respectively to two sides of a first high-frequency conductor pair in the first conductor set, thereby achieving the isolation and shielding of noise. Similarly, second to fourth high-frequency conductor pairs are respectively isolated and shielded by pairs of second to fourth intermediate conductors and welding terminals forked from the second to fourth grounding conductors. Through these grounding conductors, the electric connector is able to reduce electromagnetic or radio-frequency interference.

10 Claims, 10 Drawing Sheets

(56) References Cited

U.S. PATENT DOCUMENTS

| | | | | |
|---|---|---|---|---|
| 2005/0159040 | A1* | 7/2005 | Brunker | H01R 23/688 439/497 |
| 2005/0287850 | A1* | 12/2005 | Minich | H01R 29/00 439/108 |
| 2007/0197064 | A1* | 8/2007 | Masumoto | H01R 12/725 439/108 |
| 2010/0159751 | A1* | 6/2010 | Chiu | H01R 27/00 439/660 |
| 2012/0238146 | A1* | 9/2012 | Liao | H01R 27/02 439/660 |
| 2013/0109242 | A1* | 5/2013 | Li | H01R 12/53 439/660 |
| 2014/0235108 | A1* | 8/2014 | Shiratori | H01R 13/652 439/660 |
| 2015/0340798 | A1* | 11/2015 | Kao | H01R 13/516 439/660 |

* cited by examiner

ELECTRIC CONNECTOR

BACKGROUND OF THE INVENTION

(a) Technical Field of the Invention

The present invention is generally related to electric connectors, and more particular to an electric connector capable reducing electromagnetic or radio-frequency interference.

(b) Description of the Prior Art

High Definition Multimedia Interface (HDMI) and Display Port (DP) are two common types of audio/video (A/V) interfaces. DP can be used to transmit audio and video simultaneously or separately. DP, like HDMI, is capable of un-compressed digital data transmission, and is mainly used for the connection between computers and their screens, or between computers and home theater systems. DP, having 20 pins, is not directly compatible with HDMI, which has 19 pines. But both have identical first 13 pins.

Existing HDMI and DP connectors have the following shortcomings.

First, even though they may reduce interference when digital signal is converted to analog signal, they are susceptible to electromagnetic or radio-frequency interference between high-frequency terminals.

Second, they usually have to rely on shielding casing to achieve their tightness of internal conductors.

SUMMARY OF THE INVENTION

A major objective of the present invention is to have grounding conductors forked to surround high-frequency conductors from three sides within an insulating member, so as to shield noises.

To achieve the objectives, an electric connector of the present invention includes an insulating member, and a first conductor set and a second conductor set. The first conductor set is partially embedded in the insulating member, and comprises a contact terminal set laterally extended towards a front direction of the insulating member, a welding terminal set laterally extended towards a back direction of the insulating member, and intermediate conductor set end-to-end connecting the contact terminal set to the welding terminal set. The second conductor set is partially embedded in the insulating member, and comprises a contact terminal set laterally extended towards the front direction of the insulating member, a welding terminal set laterally extended towards the back direction of the insulating member, and intermediate conductor set end-to-end connecting the contact terminal set to the welding terminal set. The first conductor set comprises a first high-frequency conductor pair. The second conductor set comprises a first grounding conductor whose contact terminal is below and between the contact terminals of the first high-frequency conductor pair. The second conductor set further comprises a second high-frequency conductor pair disposed to a side of the first grounding conductor. The first conductor set further comprises a second grounding conductor whose contact terminal is above and between the contact terminals of second high-frequency conductor pair. The first conductor set further comprises a third high-frequency conductor pair disposed to a side of the second grounding conductor opposite to the first high-frequency conductor pair. The second conductor set further comprises third grounding conductor whose contact terminal is below and between the contact terminals of the third high-frequency conductor pair. The second conductor set further comprises a fourth high-frequency conductor pair disposed to a side of the third grounding conductor opposite to the second high-frequency conductor pair. The first conductor set further comprises a fourth grounding conductor whose contact terminal is above and between the contact terminals of fourth high-frequency conductor pair. The first conductor set further comprises a first other conductor group disposed to a side of the fourth grounding conductor opposite to the third high-frequency conductor pair. The second conductor set further comprises a second other conductor group disposed to a side of the fourth high-frequency conductor pair opposite to the third grounding conductor. The first grounding conductor has its contact terminal forked into two intermediate conductors inside the insulating member disposed respectively to two sides of the intermediate conductors of the first high-frequency conductor pair. The first grounding conductor has its contact terminal forked into two intermediate conductors inside the insulating member, disposed respectively to two sides of the intermediate conductors of the first high-frequency conductor pair. Among the welding terminal sets, there is a first high-frequency welding terminal group comprising first welding terminals connected to the intermediate conductors, respectively, of the first high-frequency conductor pair, and first welding terminals connected to the intermediate conductors, respectively, of the first grounding conductor. The first welding terminals are disposed respectively to two sides of the first welding terminals. The second grounding conductor has its contact terminal forked into two intermediate conductors inside the insulating member, disposed respectively to two sides of the intermediate conductors of the second high-frequency conductor pair. Among the welding terminal sets, there is a second high-frequency welding terminal group to a side of the first high-frequency welding terminal group, comprising second welding terminals connected to the intermediate conductors, respectively, of the second high-frequency conductor pair, and second welding terminals connected to the intermediate conductors, respectively, of the second grounding conductor. The second welding terminals are disposed respectively to two sides of the second welding terminals. The third grounding conductor has its contact terminal forked into two intermediate conductors inside the insulating member, disposed respectively to two sides of the intermediate conductors of the third high-frequency conductor pair. Among the welding terminal sets and, there is a third high-frequency welding terminal group to a side of the second high-frequency welding terminal group opposite to the first high-frequency welding terminal group, comprising third welding terminals connected to the intermediate conductors, respectively, of the third high-frequency conductor pair, and third welding terminals connected to the intermediate conductors, respectively, of the third grounding conductor. The third welding terminals are disposed respectively to two sides of the third welding terminals. The fourth grounding conductor has its contact terminal forked into two intermediate conductors inside the insulating member, disposed respectively to two sides of the intermediate conductors of the fourth high-frequency conductor pair. Among the welding terminal sets, there is a fourth high-frequency welding terminal group to a side of the third high-frequency welding terminal group opposite to the second high-frequency welding terminal group, comprising fourth welding terminals connected to the intermediate conductors, respectively, of the fourth high-frequency conductor pair, and fourth welding terminals connected to the intermediate conductors, respectively, of the fourth grounding conductor. The fourth welding terminals are disposed respectively to two sides of the fourth welding terminals. By the above structure, the first to fourth high-frequency conductor pairs are surrounded by the first to fourth grounding conductors from three sides, thereby reducing electromagnetic or radio-frequency interference.

Through the above teaching, the present invention is able to resolve the prior art's problems of electromagnetic or radio-frequency interference when HDMI or DP connectors are used for un-compressed digital data transmission, and the need for using shielding casing to improve noise interference.

The foregoing objectives and summary provide only a brief introduction to the present invention. To fully appreciate these and other objects of the present invention as well as the invention itself, all of which will become apparent to those skilled in the art, the following detailed description of the invention and the claims should be read in conjunction with the accompanying drawings. Throughout the specification and drawings identical reference numerals refer to identical or similar parts.

Many other advantages and features of the present invention will become manifest to those versed in the art upon making reference to the detailed description and the accompanying sheets of drawings in which a preferred structural embodiment incorporating the principles of the present invention is shown by way of illustrative example.

DETAILED DESCRIPTION OF THE PREFERRED EMBODIMENTS

Figure 1:
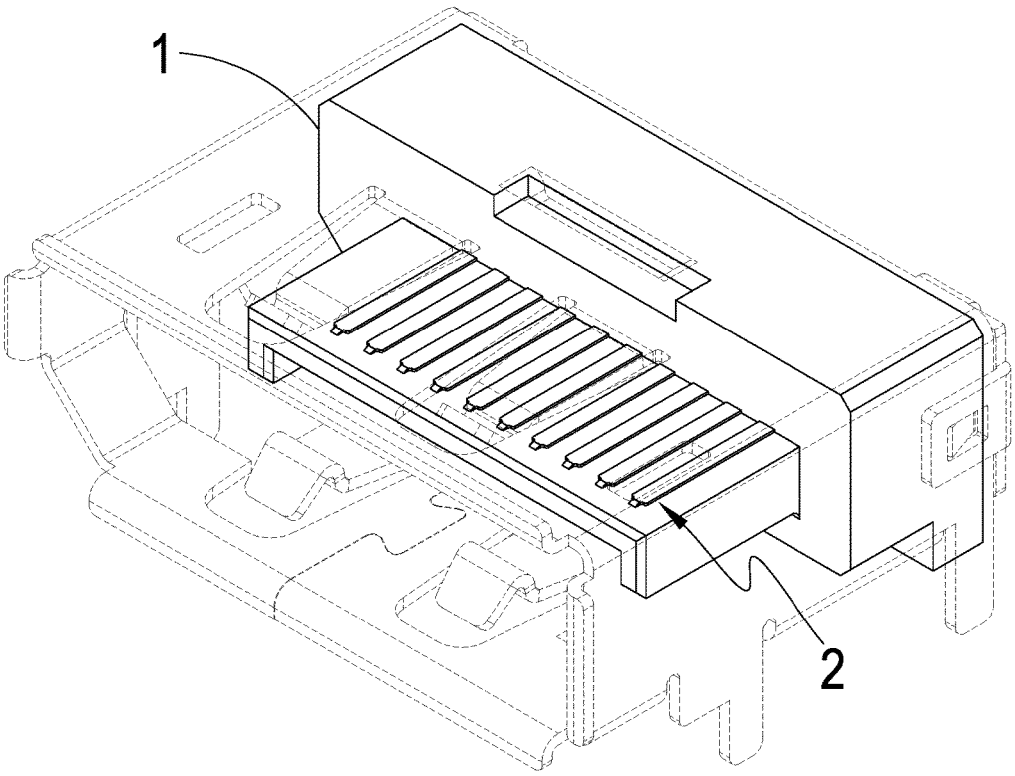
FIG. 1 is a perspective diagram showing an electric connector according to an embodiment of the present invention.
Figure 2:
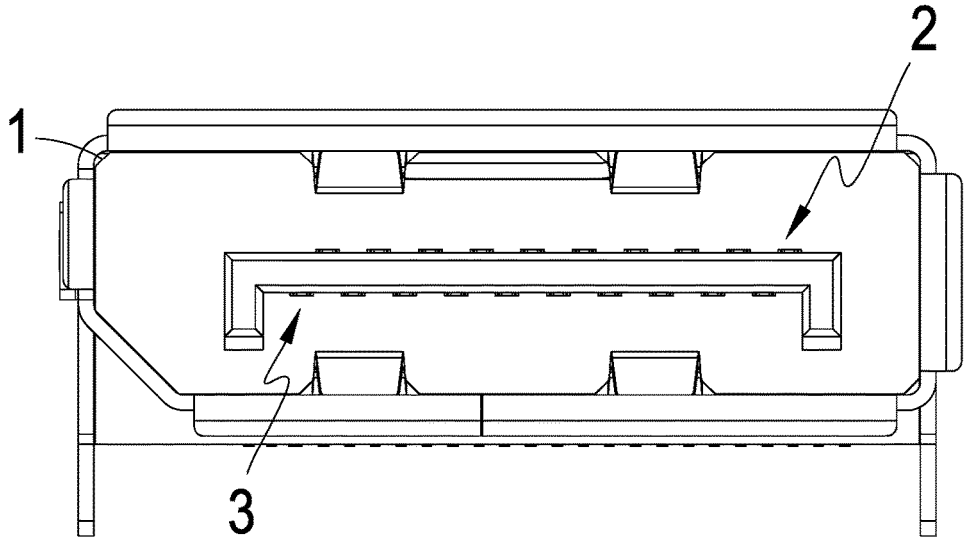
FIG. 2 is a front-view diagram showing the electric connector of FIG. 1.
Figure 3:
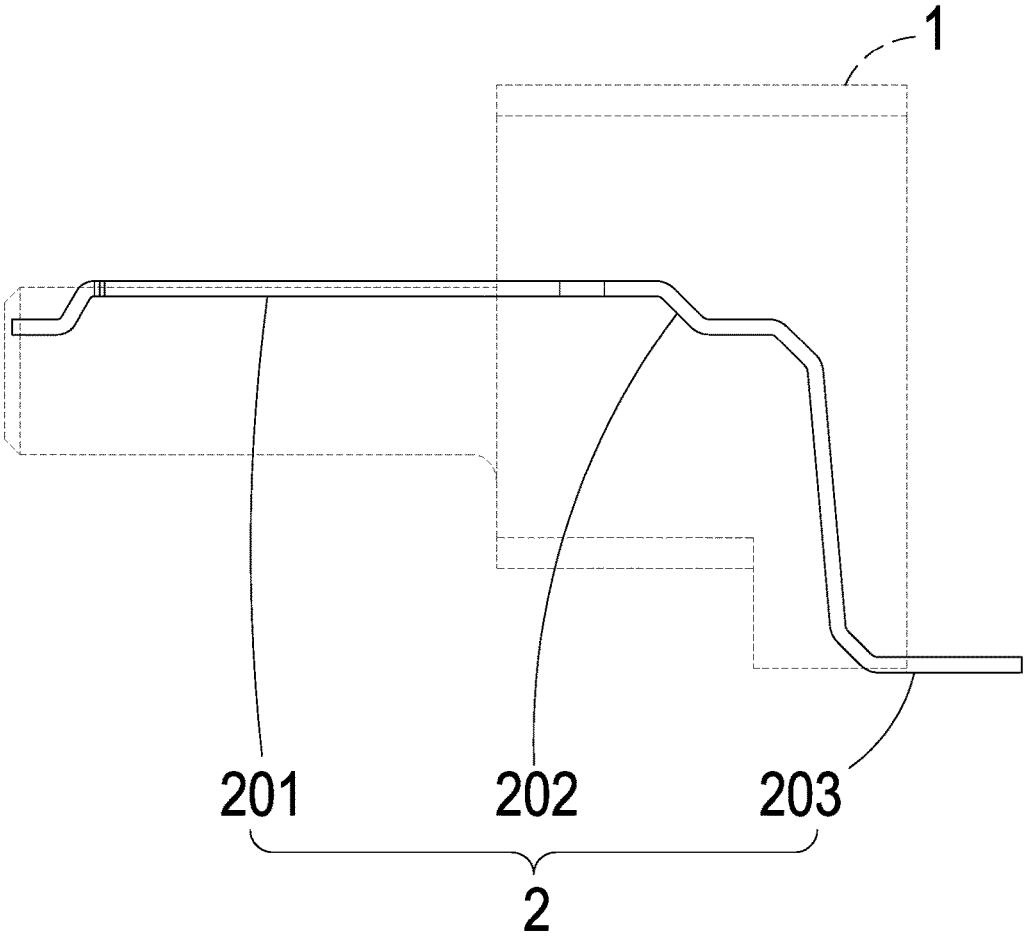
FIG. 3 is a schematic side-view diagram showing a first conductor set is integrated with an insulating member of the electric connector of FIG. 1.
Figure 4:
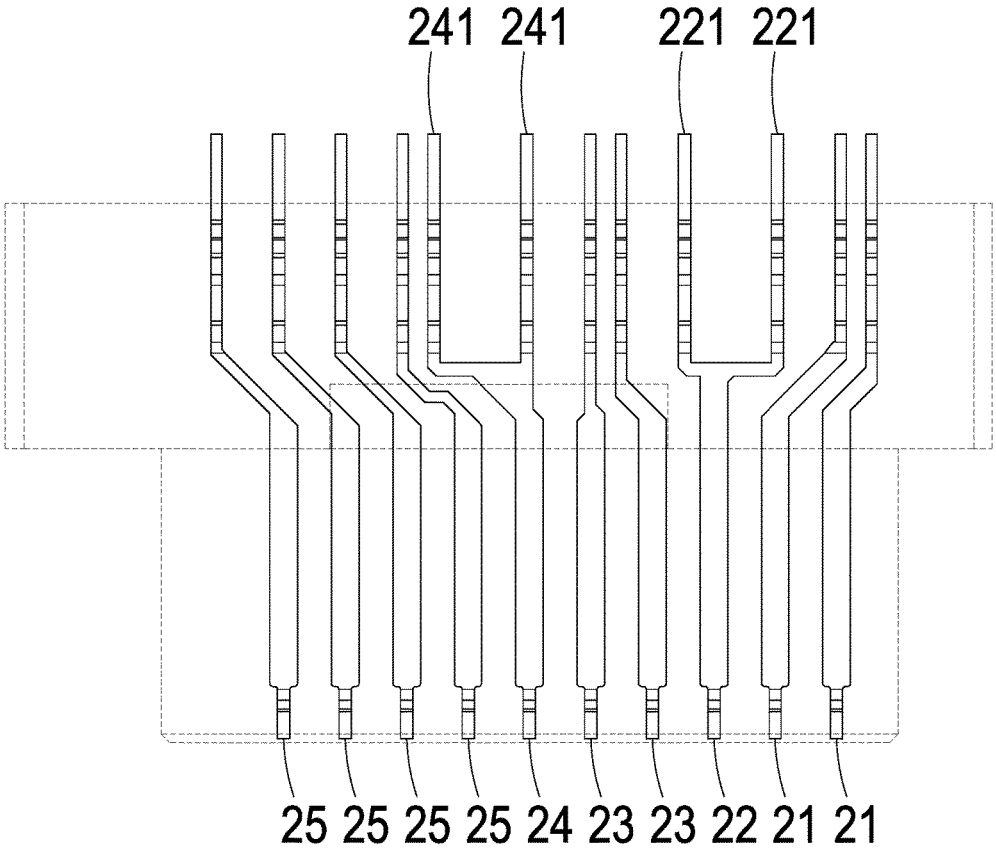
FIG. 4 is a top-view diagram to the first conductor set of FIG. 3.
Figure 5:
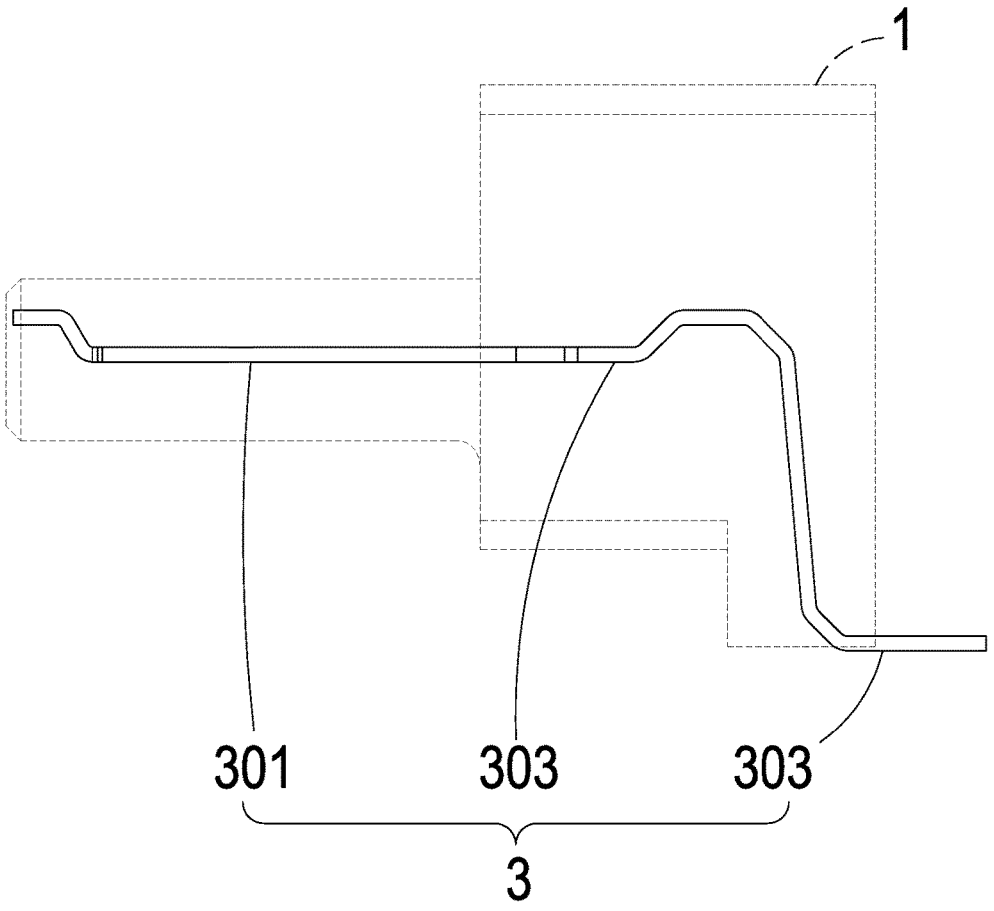
FIG. 5 is a schematic side-view diagram showing a second conductor set is integrated with an insulating member of the electric connector of FIG. 1.
Figure 6:
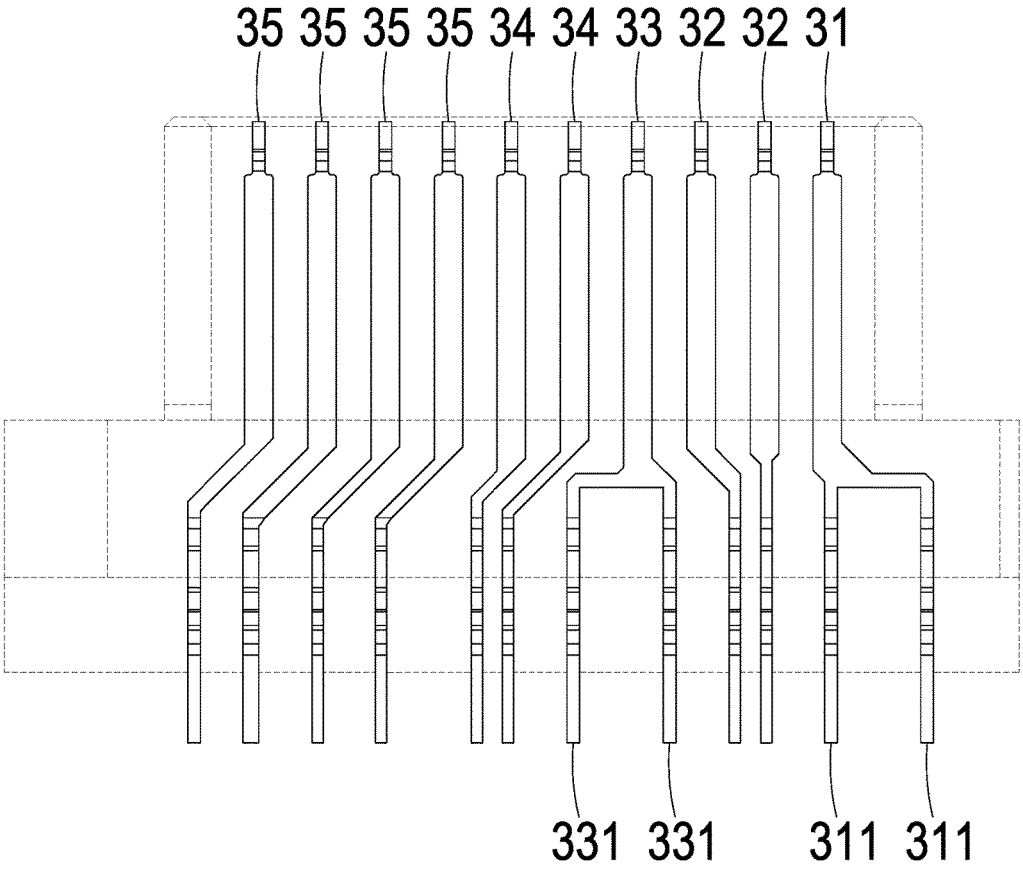
FIG. 6 is a bottom-view diagram to the second conductor set of FIG. 5.
Figure 7:
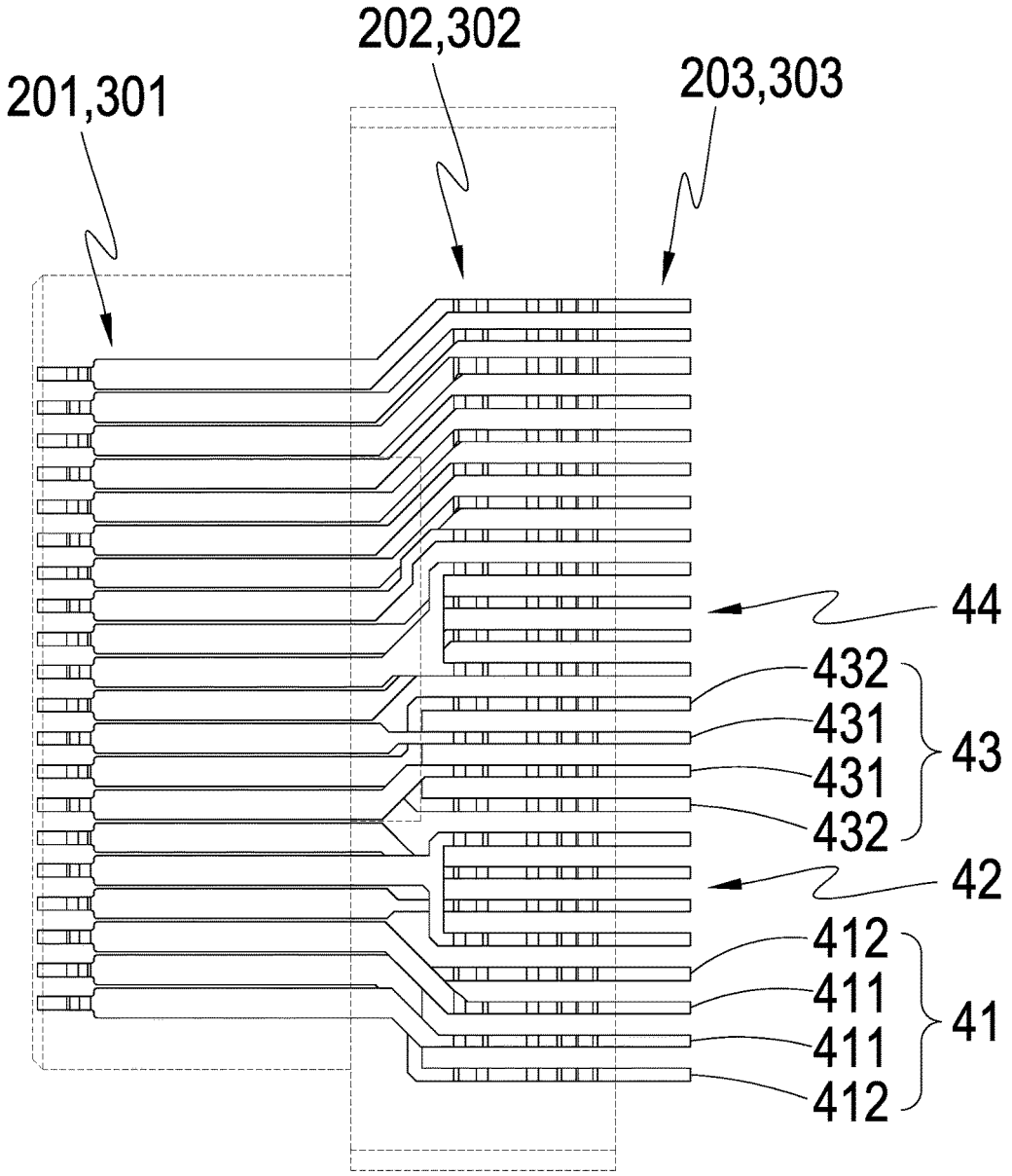
FIG. 7 is a top-view diagram showing the electric connector of FIG. 1 with shielding casing omitted.
Figure 8:
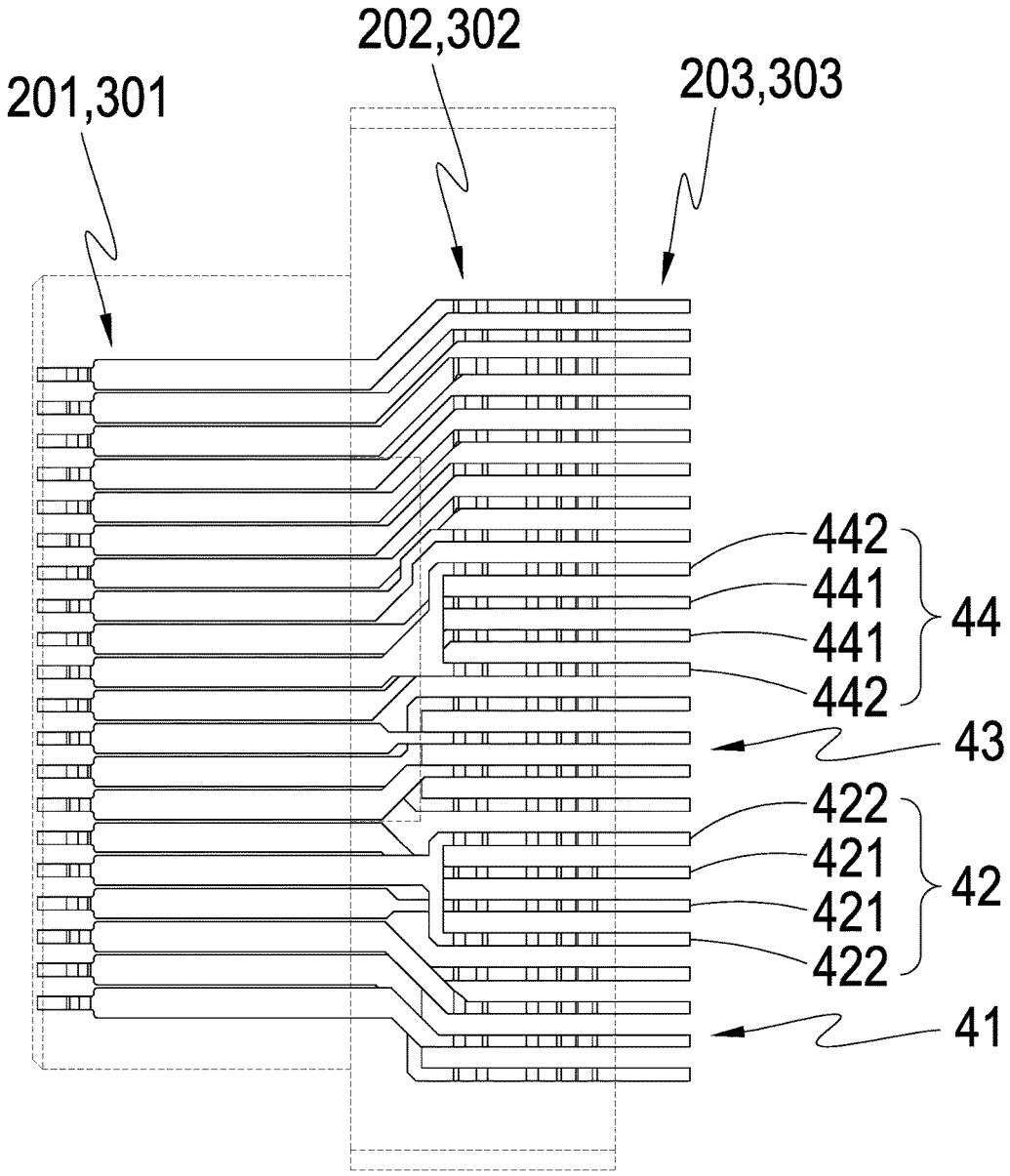
FIG. 8 is another top-view diagram showing the electric connector of FIG. 1 with shielding casing omitted.

The following descriptions are exemplary embodiments only, and are not intended to limit the scope, applicability or configuration of the invention in any way. Rather, the following description provides a convenient illustration for implementing exemplary embodiments of the invention. Various changes to the described embodiments may be made in the function and arrangement of the elements described without departing from the scope of the invention as set forth in the appended claims.

As shown in FIGS. 1 to 10, an electric connector according to an embodiment of the present invention includes:

at least an insulating member 1;

an first conductor set 2 partially embedded in the insulating member 1, and comprising a contact terminal set 201 laterally extended and exposed out of a front side of the insulating member 1, a welding terminal set 203 laterally extended and exposed out of a back side of the insulating member 1, and intermediate conductor set 202 inside the insulating member 1 connecting the contact terminal set 201 to the welding terminal set 203; and a second conductor set 3 partially embedded in the insulating member 1, and comprising a contact terminal set 301 laterally extended and exposed out of a front side of the insulating member 1, a welding terminal set 303 laterally extended and exposed out of a back side of the insulating member 1, and intermediate conductor set 302 inside the insulating member 1 connecting the contact terminal set 301 to the welding terminal set 303.

The first conductor set 2 comprises a first high-frequency conductor pair 21.

The second conductor set 3 comprises a first grounding conductor 31 whose contact terminal is below and between the contact terminals of the first high-frequency conductor pair 21.

The second conductor set 3 further comprises a second high-frequency conductor pair 32 disposed to a side of the first grounding conductor 31.

The first conductor set 2 further comprises a second grounding conductor 22 whose contact terminal is above and between the contact terminals of second high-frequency conductor pair 32.

The first conductor set 2 further comprises a third high-frequency conductor pair 23 disposed to a side of the second grounding conductor 22 opposite to the first high-frequency conductor pair 21.

The second conductor set 3 further comprises third grounding conductor 33 whose contact terminal is below and between the contact terminals of the third high-frequency conductor pair 23.

The second conductor set 3 further comprises a fourth high-frequency conductor pair 34 disposed to a side of the third grounding conductor 33 opposite to the second high-frequency conductor pair 32.

The first conductor set 2 further comprises a fourth grounding conductor 24 whose contact terminal is above and between the contact terminals of fourth high-frequency conductor pair 34.

The first conductor set 2 further comprises a first other conductor group 25 disposed to a side of the fourth grounding conductor 24 opposite to the third high-frequency conductor pair 23.

The second conductor set 3 further comprises a second other conductor group 35 disposed to a side of the fourth high-frequency conductor pair 34 opposite to the third grounding conductor 33.

The first grounding conductor 31 has its contact terminal forked into two intermediate conductors 311 inside the insulating member 1, disposed respectively to two sides of the intermediate conductors of the first high-frequency conductor pair 21.

Among the welding terminal sets 203 and 303, there is a first high-frequency welding terminal group 41 comprising first welding terminals 411 connected to the intermediate conductors, respectively, of the first high-frequency conductor pair 21, and first welding terminals 412 connected to the intermediate conductors 311, respectively, of the first grounding conductor 31. The first welding terminals 412 are disposed respectively to two sides of the first welding terminals 411.

The second grounding conductor 22 has its contact terminal forked into two intermediate conductors 221 inside the insulating member 1, disposed respectively to two sides of the intermediate conductors of the second high-frequency conductor pair 32.

Among the welding terminal sets 203 and 303, there is a second high-frequency welding terminal group 42 to a side of the first high-frequency welding terminal group 41, comprising second welding terminals 421 connected to the intermediate conductors, respectively, of the second high-frequency conductor pair 32, and second welding terminals 422 connected to the intermediate conductors 221, respectively, of the second grounding conductor 22. The second welding terminals 422 are disposed respectively to two sides of the second welding terminals 421.

The third grounding conductor 33 has its contact terminal forked into two intermediate conductors 331 inside the insulating member 1, disposed respectively to two sides of the intermediate conductors of the third high-frequency conductor pair 23.

Among the welding terminal sets 203 and 303, there is a third high-frequency welding terminal group 43 to a side of the second high-frequency welding terminal group 42 opposite to the first high-frequency welding terminal group 41, comprising third welding terminals 431 connected to the intermediate conductors, respectively, of the third high-frequency conductor pair 23, and third welding terminals 432 connected to the intermediate conductors 331, respectively, of the third grounding conductor 33. The third welding terminals 432 are disposed respectively to two sides of the third welding terminals 431.

The fourth grounding conductor 24 has its contact terminal forked into two intermediate conductors 241 inside the insulating member 1, disposed respectively to two sides of the intermediate conductors of the fourth high-frequency conductor pair 34.

Among the welding terminal sets 203 and 303, there is a fourth high-frequency welding terminal group 44 to a side of the third high-frequency welding terminal group 43 opposite to the second high-frequency welding terminal group 42, comprising fourth welding terminals 441 connected to the intermediate conductors, respectively, of the fourth high-frequency conductor pair 34, and fourth welding terminals 442 connected to the intermediate conductors 241, respectively, of the fourth grounding conductor 24. The fourth welding terminals 442 are disposed respectively to two sides of the fourth welding terminals 441. The first, second, third, and fourth welding terminal groups 41, 42, 43, and 44 are disposed on a same plane.

The first conductor set 2 and the second conductor set 3 have their contact terminal sets respectively arranged along a top side and a bottom side of a platform extended from the front side of the insulating member 1. Within the contact terminal set 201 of the first conductor set 2, there are the contact terminals from the first high-frequency conductor pair 21, second grounding conductor 22, third high-frequency conductor pair 23, fourth grounding conductor 24, and first other conductor group 25, arranged sequentially. Within the contact terminal set 301 of the second conductor set 3, there are the contact terminals from the first grounding conductor 31, second high-frequency conductor pair 32, third grounding conductor 33, fourth high-frequency conductor pair 34, and second other conductor group 35, arranged sequentially. Except the contact terminals from the first other conductor group 25 and the second other conductor group 35, the other contact terminals conform both to the specifications of High Definition Multimedia Interface (HDMI) and Display Port (DP). The electric connector of the present invention therefore is applicable to both HDMI and DP connections.

Figure 9:
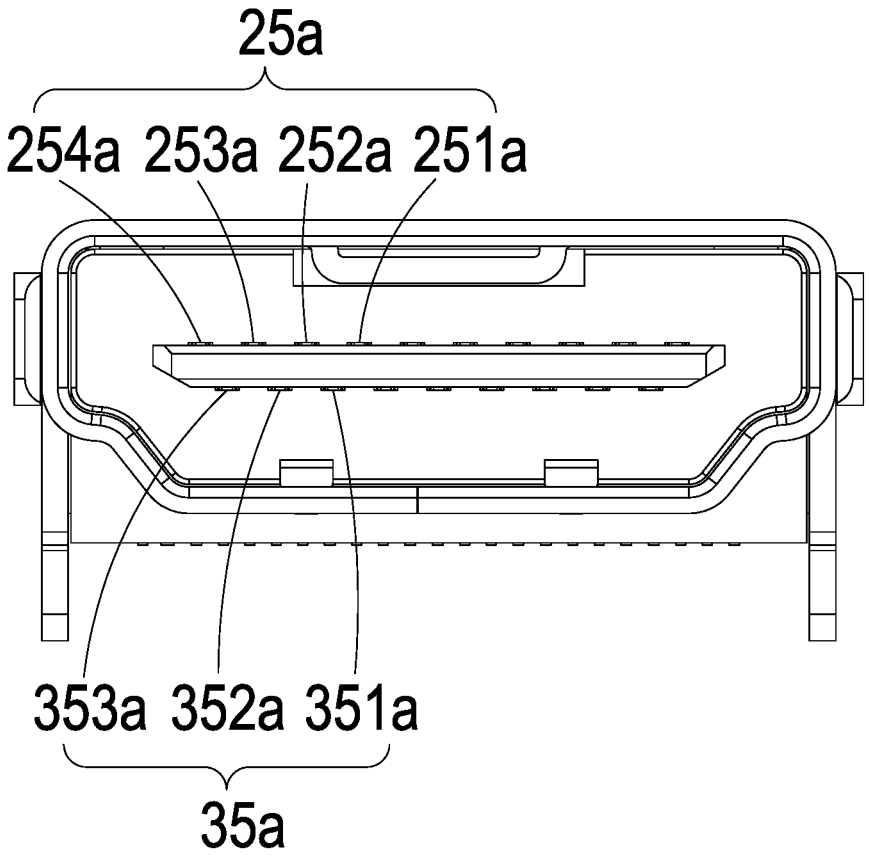
FIG. 9 is a front-view diagram showing an electric connector of the present invention applied as an HDMI connector.
Figure 10:
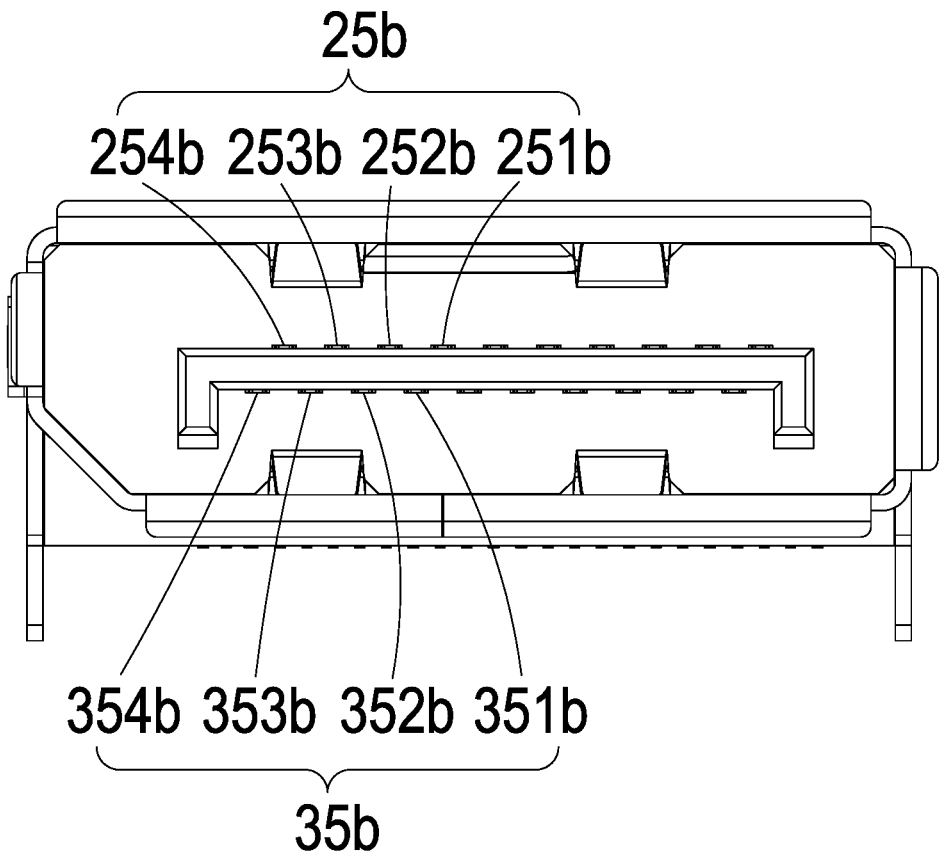
FIG. 10 is a front-view diagram showing an electric connector of the present invention applied as a DP connector.

Specifically, as shown in FIG. 9, if the electric connector of the present invention is used as a HDMI connector, the first other conductor group 25*a* of the present invention sequentially includes HDMI pins CEC 251*a*, SCL 252*a*, DDC/CEC Ground 253*a*, Hot Plug Detect 254*a*; and the second other conductor group 35*a* of the present invention sequentially includes HDMI pins Reserved 351*a*, SDA 352*a*, Power 353*a*. The contact terminals of the first other conductor group 25*a* and the second other conductor group 35*a* are interleaved. As shown in FIG. 10, if the electric connector of the present invention is used as a DP connector, the first other conductor group 25*b* sequentially includes DP pins a first GND 251*b*, AUX_CH(p) 252*b*, AUX_CH(n) 253*b*, DP_PWR Return 254*b*; and the second other conductor group 35*b* of the present invention sequentially includes DP pins a second GND 351*b*, a third GND 352*b*, Hot Plug 353*b*, and DP_PWR 354*b*. The contact terminals of the first other conductor group 25*b* and the second other conductor group 35*b* are also interleaved.

The first grounding conductor 31 of the second conductor set 3 has forked intermediate conductors 311 and welding terminals 412 to two sides of the intermediate conductions and welding terminals 411 of the first high-frequency conductor pair 21, thereby achieving the shielding of noise. Similarly, the second to fourth grounding conductors 22, 33, and 24 have forked intermediate conductors 221, 331, and 241, and welding terminals 422, 432, and 442 241 to two sides of the intermediate conductors and welding terminals 421, 431, and 441 of the second to fourth high-frequency conductor pairs 32, 23, 34. In this way, grounding conductors of the second conductor set 3 (first grounding conductor 31, third grounding conductor 32) surround the high-frequency conductor pairs of the first conductor set 2 (first high-frequency conductor pair 21, third high-frequency conductor pair 23) from three sides; grounding conductors of the first conductor set 2 (second grounding conductor 22, fourth grounding conductor 24) surround the high-frequency conductor pairs of the second conductor set 3 (second high-frequency conductor pair 32, fourth high-frequency conductor pair 34) from three sides. With grounding conductors arranged as such, the electric connector of the present invention is able to reduce electromagnetic and radio-frequency interference.

While certain novel features of this invention have been shown and described and are pointed out in the annexed claim, it is not intended to be limited to the details above, since it will be understood that various omissions, modifications, substitutions and changes in the forms and details of the device illustrated and in its operation can be made by those skilled in the art without departing in any way from the claims of the present invention.

I claim:

1. An electric connector, comprising:

at least an insulating member;

an first conductor set partially embedded in the insulating member, and comprising a contact terminal set laterally extended towards a front direction of the insulating member, a welding terminal set laterally extended towards a back direction of the insulating member, and intermediate conductor set end-to-end connecting the contact terminal set to the welding terminal set; and a second conductor set partially embedded in the insulating member, and comprising a contact terminal set laterally extended towards the front direction of the insulating member, a welding terminal set laterally extended towards the back direction of the insulating member, and intermediate conductor set end-to-end connecting the contact terminal set to the welding terminal set;

wherein the first conductor set comprises a first high-frequency conductor pair;

the second conductor set comprises a first grounding conductor whose contact terminal is below and between the contact terminals of the first high-frequency conductor pair;

the second conductor set further comprises a second high-frequency conductor pair disposed to a side of the first grounding conductor;

the first conductor set further comprises a second grounding conductor whose contact terminal is above and between the contact terminals of second high-frequency conductor pair;

the first conductor set further comprises a third high-frequency conductor pair disposed to a side of the second grounding conductor opposite to the first high-frequency conductor pair;

the second conductor set further comprises third grounding conductor whose contact terminal is below and between the contact terminals of the third high-frequency conductor pair;

the second conductor set further comprises a fourth high-frequency conductor pair disposed to a side of the third grounding conductor opposite to the second high-frequency conductor pair;

the first conductor set further comprises a fourth grounding conductor whose contact terminal is above and between the contact terminals of fourth high-frequency conductor pair;

the first conductor set further comprises a first other conductor group disposed to a side of the fourth grounding conductor opposite to the third high-frequency conductor pair;

the second conductor set further comprises a second other conductor group disposed to a side of the fourth high-frequency conductor pair opposite to the third grounding conductor;

the first grounding conductor has its contact terminal forked into two intermediate conductors inside the insulating member disposed respectively to two sides of the intermediate conductors of the first high-frequency conductor pair;

the first grounding conductor has its contact terminal forked into two intermediate conductors inside the insulating member, disposed respectively to two sides of the intermediate conductors of the first high-frequency conductor pair;

among the welding terminal sets, there is a first high-frequency welding terminal group comprising first welding terminals connected to the intermediate conductors, respectively, of the first high-frequency conductor pair, and first welding terminals connected to the intermediate conductors, respectively, of the first grounding conductor;

the first welding terminals are disposed respectively to two sides of the first welding terminals;

the second grounding conductor has its contact terminal forked into two intermediate conductors inside the insulating member, disposed respectively to two sides of the intermediate conductors of the second high-frequency conductor pair;

among the welding terminal sets, there is a second high-frequency welding terminal group to a side of the first high-frequency welding terminal group, comprising second welding terminals connected to the intermediate conductors, respectively, of the second high-frequency conductor pair, and second welding terminals connected to the intermediate conductors, respectively, of the second grounding conductor;

the second welding terminals are disposed respectively to two sides of the second welding terminals;

the third grounding conductor has its contact terminal forked into two intermediate conductors inside the insulating member, disposed respectively to two sides of the intermediate conductors of the third high-frequency conductor pair;

among the welding terminal sets and, there is a third high-frequency welding terminal group to a side of the second high-frequency welding terminal group opposite to the first high-frequency welding terminal group, comprising third welding terminals connected to the intermediate conductors, respectively, of the third high-frequency conductor pair, and third welding terminals connected to the intermediate conductors, respectively, of the third grounding conductor;

the third welding terminals are disposed respectively to two sides of the third welding terminals;

the fourth grounding conductor has its contact terminal forked into two intermediate conductors inside the insulating member, disposed respectively to two sides of the intermediate conductors of the fourth high-frequency conductor pair;

among the welding terminal sets, there is a fourth high-frequency welding terminal group to a side of the third high-frequency welding terminal group opposite to the second high-frequency welding terminal group, comprising fourth welding terminals connected to the intermediate conductors, respectively, of the fourth high-frequency conductor pair, and fourth welding terminals connected to the intermediate conductors, respectively, of the fourth grounding conductor; and the fourth welding terminals are disposed respectively to two sides of the fourth welding terminals.

2. The electric connector according to claim 1, wherein the contact terminals of the first and second conductor sets are exposed from a front side of the insulating member and respectively arranged along a top side and a bottom side of a platform extended from the front side of the insulating member.

3. The electric connector according to claim 1, wherein the intermediate conductor sets of the first and second conductor sets are inside the insulating member.

4. The electric connector according to claim 1, wherein the welding terminal sets of the first and second conductor sets are exposed out of a back side of the insulating member.

5. The electric connector according to claim 1, wherein the welding terminals of the first and second conductor sets jointly span a width larger than that jointly spanned by the contact terminals of the first and second conductor sets.

6. An electric connector, comprising:

at least an insulating member;

an first conductor set partially embedded in the insulating member, and comprising a contact terminal set laterally extended towards a front direction of the insulating member, a welding terminal set laterally extended towards a back direction of the insulating member, and intermediate conductor set end-to-end connecting the contact terminal set to the welding terminal set; and a second conductor set partially embedded in the insulating member, and comprising a contact terminal set laterally extended towards the front direction of the insulating member, a welding terminal set laterally extended towards the back direction of the insulating member, and intermediate conductor set end-to-end connecting the contact terminal set to the welding terminal set;

wherein the first conductor set comprises a first high-frequency conductor pair;

the second conductor set comprises a first grounding conductor whose contact terminal is below and between the contact terminals of the first high-frequency conductor pair;

the second conductor set further comprises a second high-frequency conductor pair disposed to a side of the first grounding conductor;

the first conductor set further comprises a second grounding conductor whose contact terminal is above and between the contact terminals of second high-frequency conductor pair;

the first conductor set further comprises a third high-frequency conductor pair disposed to a side of the second grounding conductor opposite to the first high-frequency conductor pair;

the second conductor set further comprises third grounding conductor whose contact terminal is below and between the contact terminals of the third high-frequency conductor pair;

the second conductor set further comprises a fourth high-frequency conductor pair disposed to a side of the third grounding conductor opposite to the second high-frequency conductor pair;

the first conductor set further comprises a fourth grounding conductor whose contact terminal is above and between the contact terminals of fourth high-frequency conductor pair;

the first conductor set further comprises a first other conductor group disposed to a side of the fourth grounding conductor opposite to the third high-frequency conductor pair;

the second conductor set further comprises a second other conductor group disposed to a side of the fourth high-frequency conductor pair opposite to the third grounding conductor;

the first grounding conductor has its contact terminal forked into two intermediate conductors inside the insulating member disposed respectively to two sides of the intermediate conductors of the first high-frequency conductor pair;

the first grounding conductor has its contact terminal forked into two intermediate conductors inside the insulating member, disposed respectively to two sides of the intermediate conductors of the first high-frequency conductor pair;

among the welding terminal sets, there is a first high-frequency welding terminal group comprising first welding terminals connected to the intermediate conductors, respectively, of the first high-frequency conductor pair, and first welding terminals connected to the intermediate conductors, respectively, of the first grounding conductor;

the first welding terminals are disposed respectively to two sides of the first welding terminals;

the second grounding conductor has its contact terminal forked into two intermediate conductors inside the insulating member, disposed respectively to two sides of the intermediate conductors of the second high-frequency conductor pair;

among the welding terminal sets, there is a second high-frequency welding terminal group to a side of the first high-frequency welding terminal group, comprising second welding terminals connected to the intermediate conductors, respectively, of the second high-frequency conductor pair, and second welding terminals connected to the intermediate conductors, respectively, of the second grounding conductor;

the second welding terminals are disposed respectively to two sides of the second welding terminals;

the third grounding conductor has its contact terminal forked into two intermediate conductors inside the insulating member, disposed respectively to two sides of the intermediate conductors of the third high-frequency conductor pair;

among the welding terminal sets and, there is a third high-frequency welding terminal group to a side of the second high-frequency welding terminal group opposite to the first high-frequency welding terminal group, comprising third welding terminals connected to the intermediate conductors, respectively, of the third high-frequency conductor pair, and third welding terminals connected to the intermediate conductors, respectively, of the third grounding conductor;

the third welding terminals are disposed respectively to two sides of the third welding terminals;

the fourth grounding conductor has its contact terminal forked into two intermediate conductors inside the insulating member, disposed respectively to two sides of the intermediate conductors of the fourth high-frequency conductor pair;

among the welding terminal sets, there is a fourth high-frequency welding terminal group to a side of the third high-frequency welding terminal group opposite to the second high-frequency welding terminal group, comprising fourth welding terminals connected to the intermediate conductors, respectively, of the fourth high-frequency conductor pair, and fourth welding terminals connected to the intermediate conductors, respectively, of the fourth grounding conductor;

the fourth welding terminals are disposed respectively to two sides of the fourth welding terminals; and the welding terminal terminals of the first and second conductor sets are disposed on a same plane.

7. The electric connector according to claim 6, wherein the contact terminals of the first and second conductor sets are exposed from a front side of the insulating member and respectively arranged along a top side and a bottom side of a platform extended from the front side of the insulating member.

8. The electric connector according to claim 6, wherein the intermediate conductor sets of the first and second conductor sets are inside the insulating member.

9. The electric connector according to claim 6, wherein the welding terminal sets of the first and second conductor sets are exposed out of a back side of the insulating member.

10. The electric connector according to claim 6, wherein the welding terminals of the first and second conductor sets jointly span a width larger than that jointly spanned by the contact terminals of the first and second conductor sets.

* * * * *